United States Patent [19]

Hara

[11] Patent Number: 4,610,067

[45] Date of Patent: Sep. 9, 1986

[54] BINDING TOOL

[75] Inventor: Kunio Hara, Kawasaki, Japan

[73] Assignee: Nifco Inc., Yokohama, Japan

[21] Appl. No.: 752,699

[22] Filed: Jul. 8, 1985

[30] Foreign Application Priority Data

Jul. 10, 1984 [JP] Japan ..... 59-141453

[51] Int. Cl.[4] ..... B21F 9/02

[52] U.S. Cl. ..... 29/33.5; 140/93 A; 140/93.2

[58] Field of Search ..... 29/33.5; 140/54, 57, 140/93 R, 93 A, 93.2, 93.4, 93.6, 102.5, 111, 116, 117, 118, 119, 120, 122, 123, 123.5, 123.6; 100/26, 31, 33 R, 33 PB

[56] References Cited

U.S. PATENT DOCUMENTS

| | | | |
|---|---|---|---|
| 3,391,440 | 7/1968 | Harms | 140/93.2 X |
| 3,391,715 | 7/1968 | Thompson | 140/93.6 |
| 3,570,554 | 3/1971 | Kabel | 140/93.2 |
| 3,621,889 | 11/1971 | Hidassy | 140/93.2 |
| 3,633,633 | 1/1972 | Countryman | 140/93.2 |
| 3,976,108 | 8/1976 | Caveney et al. | 140/93 A |
| 4,004,618 | 1/1977 | Turek | 140/93 A X |
| 4,119,124 | 10/1978 | Collier et al. | 140/93.2 |
| 4,368,762 | 1/1983 | Peterpaul | 140/93.2 X |
| 4,371,010 | 2/1983 | Hidassy | 140/93 A |

*Primary Examiner*—Gil Weidenfeld
*Assistant Examiner*—Glenn L. Webb
*Attorney, Agent, or Firm*—Trexler, Bushnell & Wolters, Ltd.

[57] ABSTRACT

A binding tool in which a fastener row consisting of a plurality of fasteners arranged side by side at a predetermined pitch is fed by increments corresponding to said pitch, a binding tape is fed into the leading fastener in a set position from behind in a tool body, the tape emerging from the front end of the fastener is passed around an object, the leading end of the tape is inserted into the fastener from the front end, the tape end emerging from the rear end of the fastener is clamped by a stopper in the body, the tape is pulled back to be tightened around the object, the tape is secured to the fastener by driving an associated pin thereinto in the body, the tape is cut behind the fastener.

1 Claim, 23 Drawing Figures

FIG. 4
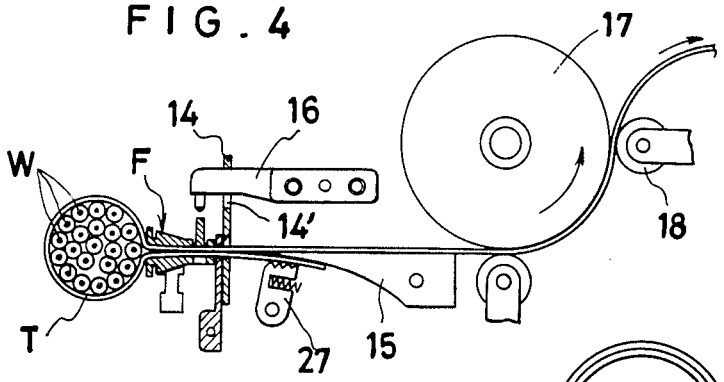
FIG. 6
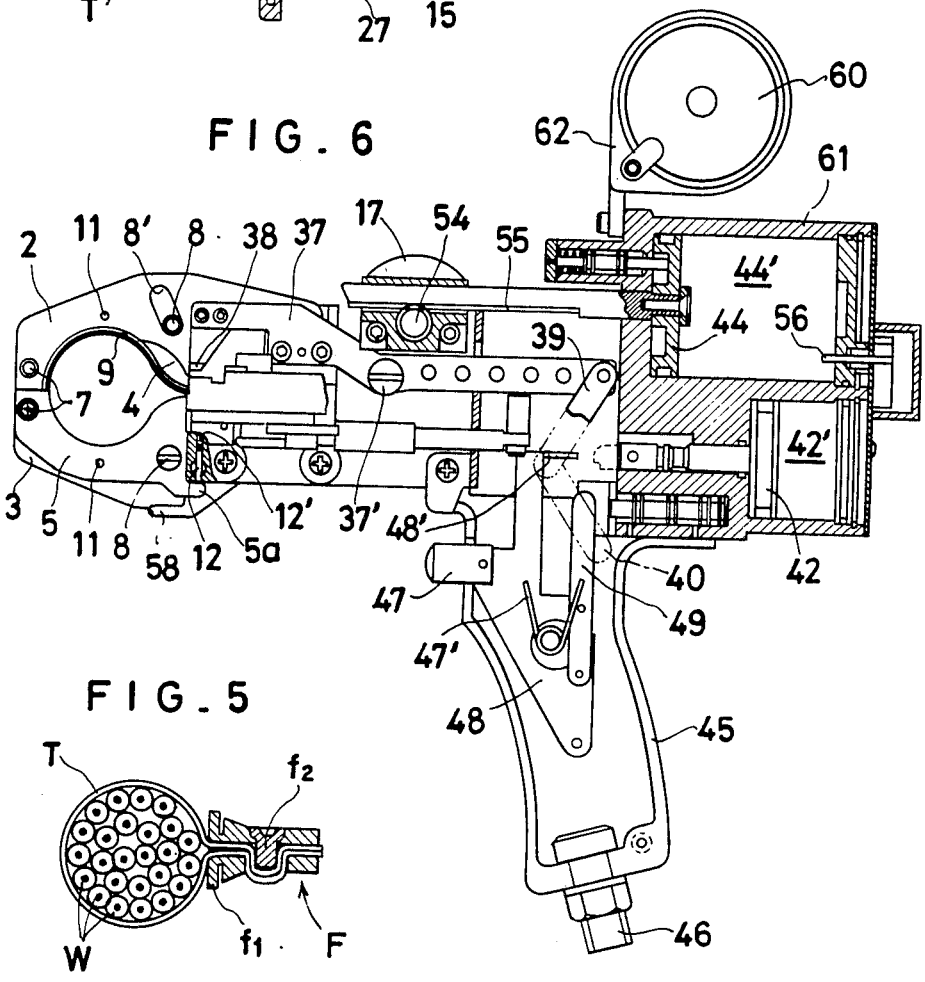
FIG. 5

FIG. 8
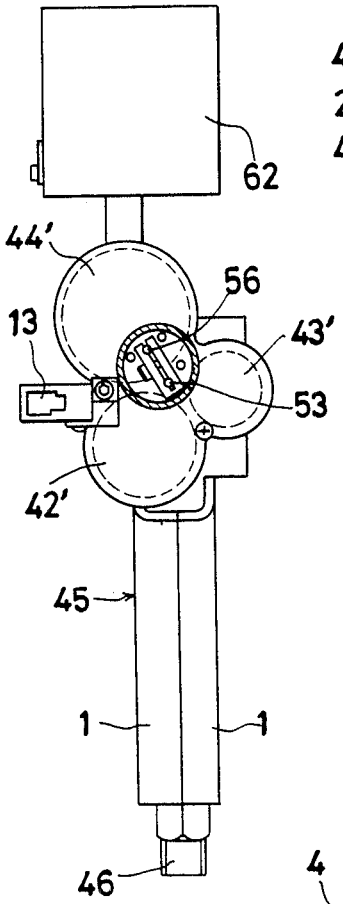
FIG. 9
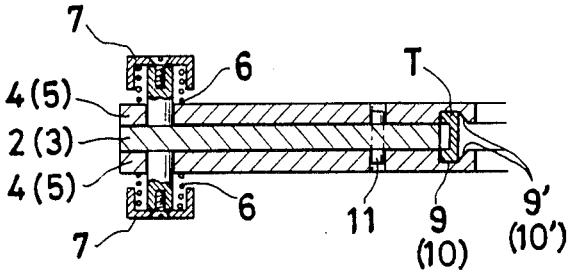
FIG. 11
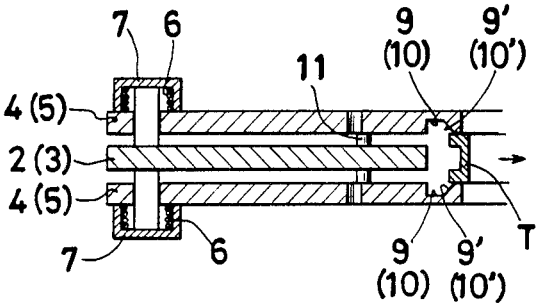
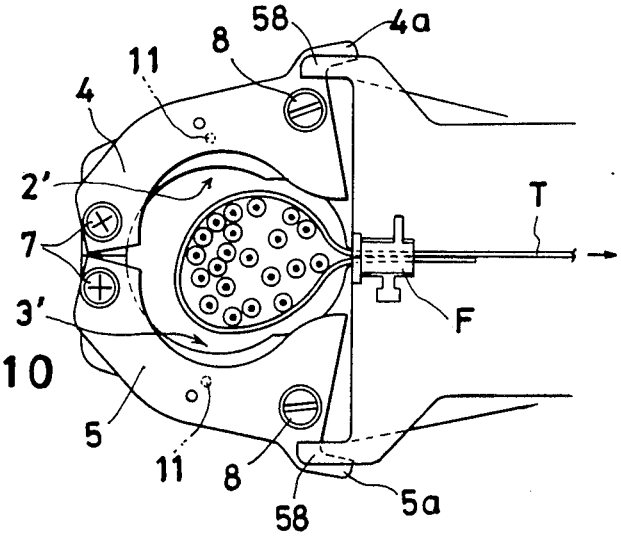
FIG. 10

FIG. 14
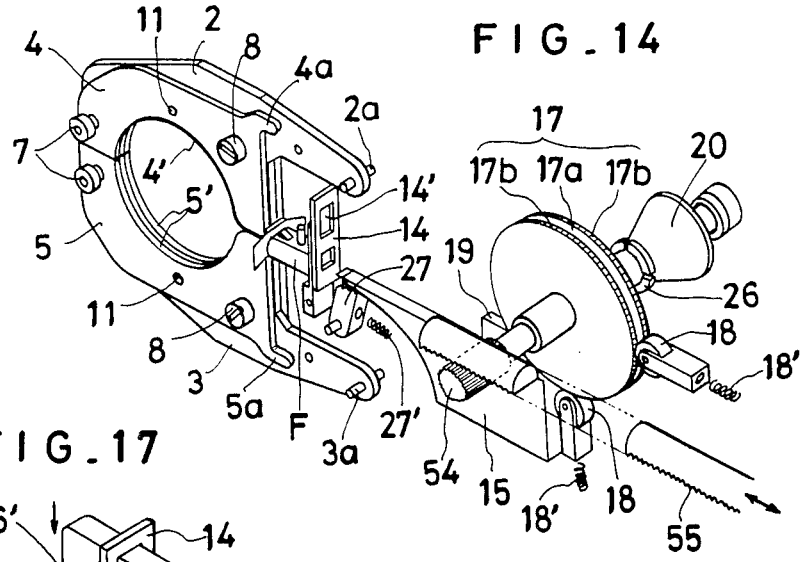
FIG. 17
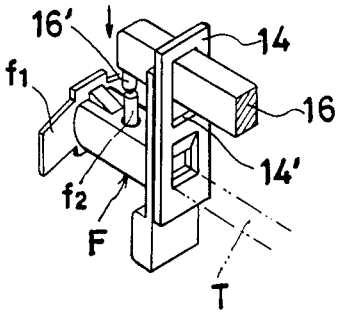
FIG. 15
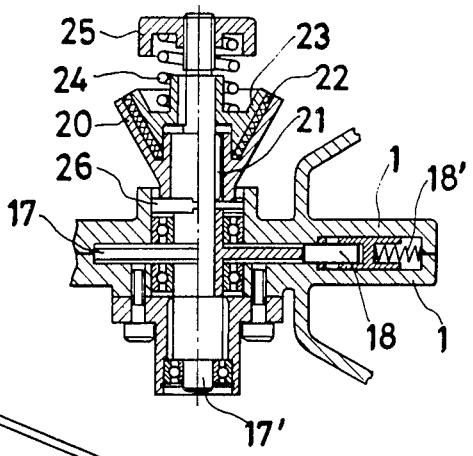
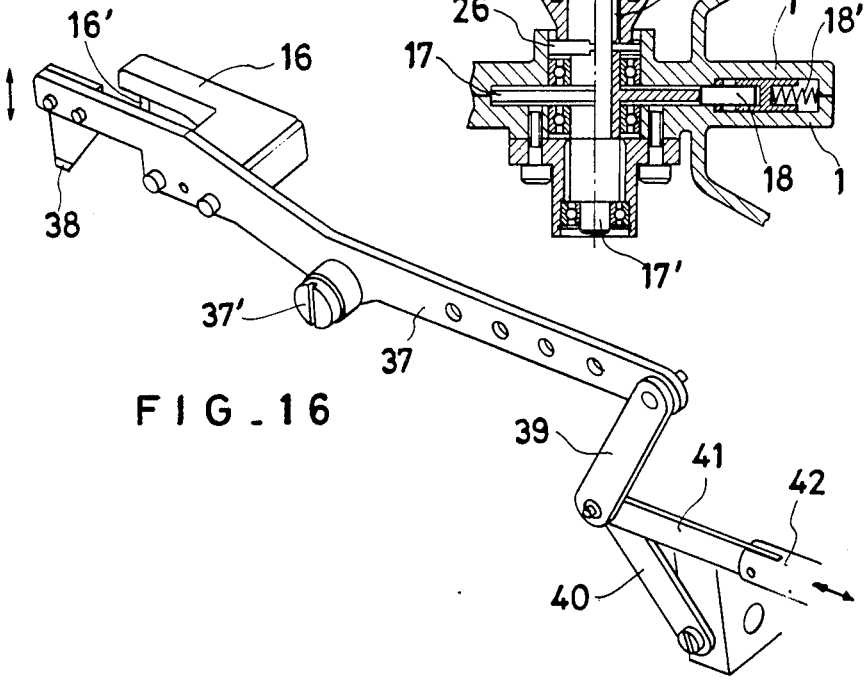
FIG. 16

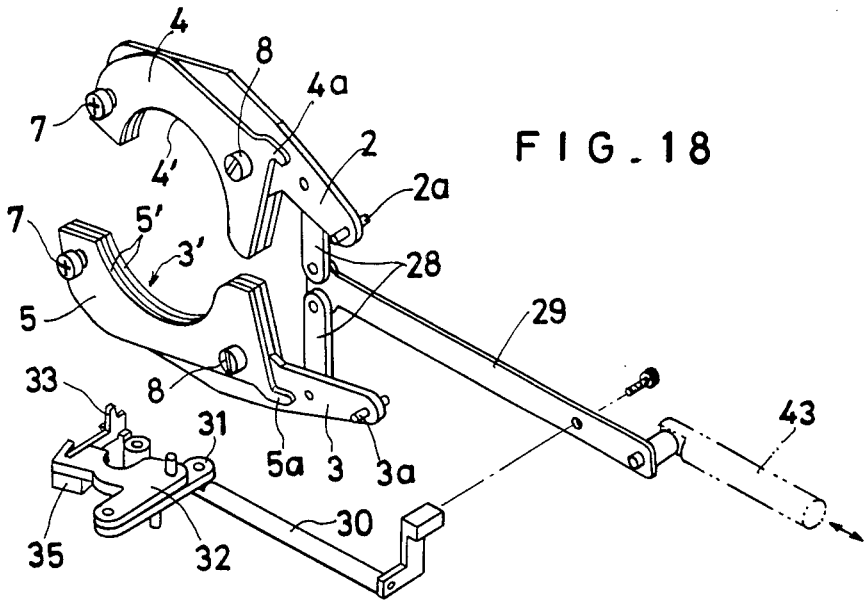
FIG. 18
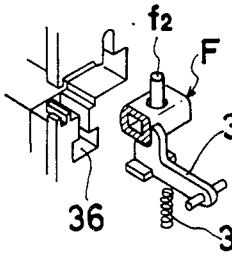
FIG. 19
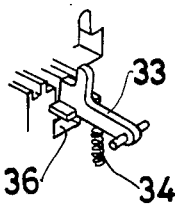
FIG. 20
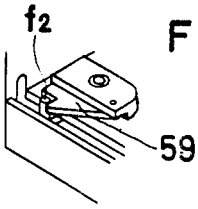
FIG. 21
FIG. 22
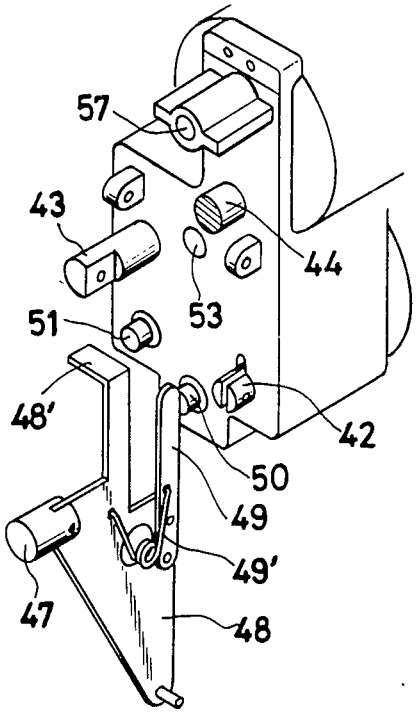

BINDING TOOL

FIELD OF THE INVENTION

This invention relates to an entirely automatic binding tool for binding together a set of electric wires or the like by passing a tape once around the set of wires (object) to be bound and joining together the opposite ends of the tape by passing them through a fastener and driving a pin into the fastener.

DESCRIPTION OF THE PRIOR ART

U.S. Pat. No. 3,353,227 discloses a binding tool which can bind an object by passing a tape round the object and joining together the opposite ends of the tape with a pin driven into a fastener.

With this binding tool, the tape is manually fed out to the outside of a tool body through a front end of the fastener, the portion of the tape fed to the outside is manually passed around the object, the leading end of the tape is manually inserted into the end of the tool, the tape is tightened around the object by manually turning a tape reel in the reverse direction, a pin is driven into the fastener by gripping a handle of the tool to thereby have the opposite ends of the tape secured to the fastener, and marginal end portions of the tape are cut away. The tool, therefore, is only semi-automatic in operation, and a considerable number of manual operations are required to bind the object. In addition, the fastening force with which the tape can be tightened around the object depends on the extent to which the tape reel is manually turned in the reverse direction. The fastening force, therefore, varies with each binding cycle, and considerable skill is required to apply substantially a constant fastening force.

OBJECTS AND SUMMARY OF THE INVENTION

An object of the invention is to provide a binding tool which permits adjustment of the fastening force applied to the tape and effects the operations of passing the tape around an object, fastening the passed tape, cutting the tape and feeding a new fastener entirely automatically.

Another object of the invention is to provide a binding tool, which can provide an optimum and substantially constant fastening force.

To attain the above objects of the invention, there is provided a binding tool of the type in which a fastener row consisting of a plurality of fasteners arranged side by side at a predetermined pitch is fed by increments corresponding to said pitch, a binding tape is fed into the leading fastener in a set position from behind in a tool body, the tape emerging from the front end of the fastener is passed around an object, the leading end of the tape is inserted into the fastener from the front end, the tape end emerging from the rear end of the fastener is clamped by a stopper in the body, the tape is pulled back to be tightened around the object, the tape is secured to the fastener by driving an associated pin thereinto in the body, the tape is cut behind the fastener, the binding tool comprising an upper jaw and a lower jaw both having a thickness smaller than the width of the tape, said jaws being pivotally coupled to the body at the position where the tape emerges from the front end of the fastener at the front end of the body and being arranged to form a space between them when they are closed onto each other, paired side plates provided in a spring-biased relation on the opposite sides of each of said jaws so as to open and close in unison with the jaws, the paired side plates being rotatable about the front end of the jaws, holding means provided between each jaw and each of the associated side plates for holding the side plates in a tape-guiding relation with respect to the associated jaws and for releasing the side plates when the side plates are separated from the corresponding side surfaces of the jaws against biasing force, the side plates defining an enclosed space when they are closed which is smaller than the space defined by the jaws in the closed state thereof and has a narrowed portion at the position where the tape emerges from the body, grooves formed in the opposed surfaces of the paired side plates for guiding the edges of the tape, the grooves having inclined surfaces against which the edges of the tape ride to separate the side plates from the corresponding side surfaces of the jaws for escaping into the enclosed space, drive means for opening and closing said jaws, urging means having springs in contact with the side plates for pushing the side plates of the upper jaw upwardly and the side plates of the lower jaw downwardly when the jaws are closed, tape reciprocation means rotatable by a predetermined fixed amount in one direction to feed out the tape and slippably rotatable by the same amount in the reverse direction to pull back the tape, and slip control means for controlling the slipping of said tape reciprocation means, said drive means, urging means, tape reciprocation means and slip-control means being housed in said tool body.

With the binding tool of this construction, an object to be bound is inserted between the two open jaws, then the jaws are closed by the jaw driving mechanism. The tape is fed out by the predetermined amount by rotating the tape reciprocation mechanism by a predetermined amount in one direction. The tape thus proceeds to the outside of the tool body through the front end of the fastener with its opposite edges guided along grooves provided in the paired side plates provided on opposite sides of either the upper or the lower jaw to be passed around about one half the circumference of the object to be bound, then further proceeds with the edges similarly guided along grooves provided in paired side plates provided on opposite sides of the other jaw to be passed around the remaining half of the object's circumference. The tape then enters the fastener from the front end thereof, and is stopped slightly after emerging from the rear end of the fastener. At this time the leading end of the tape is clamped by a stopper.

Subsequently, the tape reciprocation mechanism is rotated by the predetermined amount in the reverse direction to pull back the tape. At this time, the tape reciprocation driver slips. Therefore, the fed-out tape cannot be entirely pulled back by the rotation of the tape reciprocation driver by the same amount in the reverse direction.

The pulling force applied to the tape by the slipping rotation of the tape reciprocation mechanism causes the portions (edges) of the tape received in the grooves formed in the paired side plates on the opposite sides of the jaws to ride on the inclined side surfaces of the grooves, whereby the tape can escape into the enclosed space. At this time the side plates separated from the corresponding side surfaces of the jaws are released by the holding means and made free with respect to the jaws, so that they are urged and turned by the urging means, the side plates associated with the upper jaw being turned upwardly and the side plates associated with the lower jaw being turned downwardly, about the front ends of the jaws, to expose the space enclosed by the jaws. Consequently, the object is pulled toward the front end of the body with the drawing-in of the tape. Subsequently, the tape is secured to the fastener by a pin driven into the fastener. The tape is then cut behind the fastener, and the jaws are opened to take out the bound object. The slippage of the tape reciprocation mechanism can be adjusted to provide a desired object binding force.

BRIEF DESCRIPTION OF THE DRAWINGS

The above and other objects, features and advantages of the invention will become more apparent from the description of a preferred embodiment thereof when the same is read with reference to the accompanying drawings, in which:

FIG. 4 is a view showing part of the binding tool in the process of tightening the tape after it has been passed around the object;

FIG. 5 is a view showing the bound object;

FIG. 6 is a side view, partly in section, showing an embodiment of the binding tool according to the invention;

FIG. 8 is a back view, partly in section, showing the binding tool shown in FIG. 6;

FIG. 9 is a sectional view showing a jaw and associated paired side plates when the two jaws of the binding tool are closed onto each other;

FIG. 10 is a fragmentary side view showing part of the binding tool with the tape pulled back and the paired side plates rotated with respect to the jaws;

FIG. 11 is a sectional view, showing the part shown in FIG. 10 in the same state;

FIG. 14 is a fragmentary perspective view showing a tape reciprocation driver;

FIG. 15 is a sectional view showing a slip mechanism of the tape reciprocation driver;

FIG. 16 is a fragmentary perspective view showing a mechanism for cutting a connector between adjacent fasteners, cutting the tape, and driving a pin;

FIG. 17 is a fragmentary perspective view showing a portion of the same mechanism for cutting the tape and driving the pin;

FIG. 18 is a fragmentary perspective view showing a mechanism for opening and closing two jaws and feeding a fastener group;

FIG. 19 is a fragmentary perspective view showing the fastener feeding mechanism in the process of feeding a fastener;

FIG. 20 is a fragmentary perspective view showing the same mechanism with the feed interrupted in the absence of any fastener;

FIG. 21 is a fragmentary perspective view showing a mechanism accessory to the fastener feeding mechanism for preventing reverse travel of the fastener;

FIG. 22 is a fragmentary perspective view showing a cylinder block for performing the entire binding cycle by hydraulic operation.

DESCRIPTION OF THE PREFERRED EMBODIMENT

Figure 1:
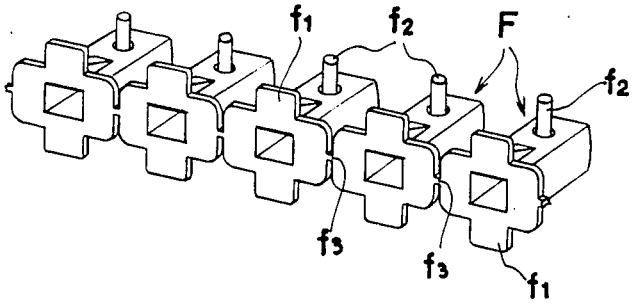
FIG. 1 is a perspective view showing a fastener group which can be used with the binding tool according to the invention.

FIG. 1 shows an example of a group of fasteners F used with the binding tool according to the invention. Each fastener F has a front flange $f_1$ and a rear portion provided with a pin $f_2$ which can be driven into the fastener body. The individual fasteners F are joined together side by side at a predetermined interval by connectors $f_3$ between adjacent flanges of adjacent fasteners.

Figure 2:
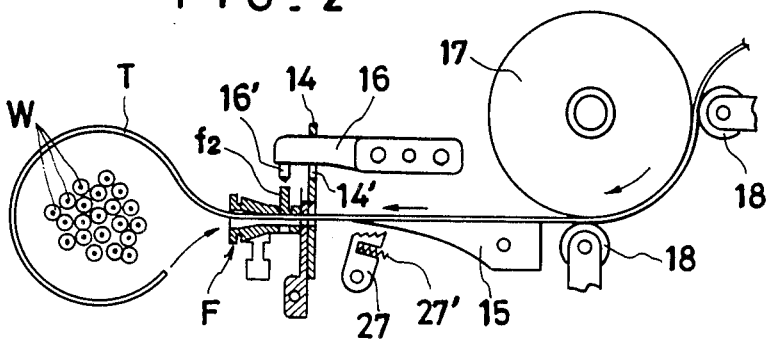
FIG. 2 is a view showing part of the binding tool according to the invention in the process of passing a tape around an object to be bound.
Figure 3:
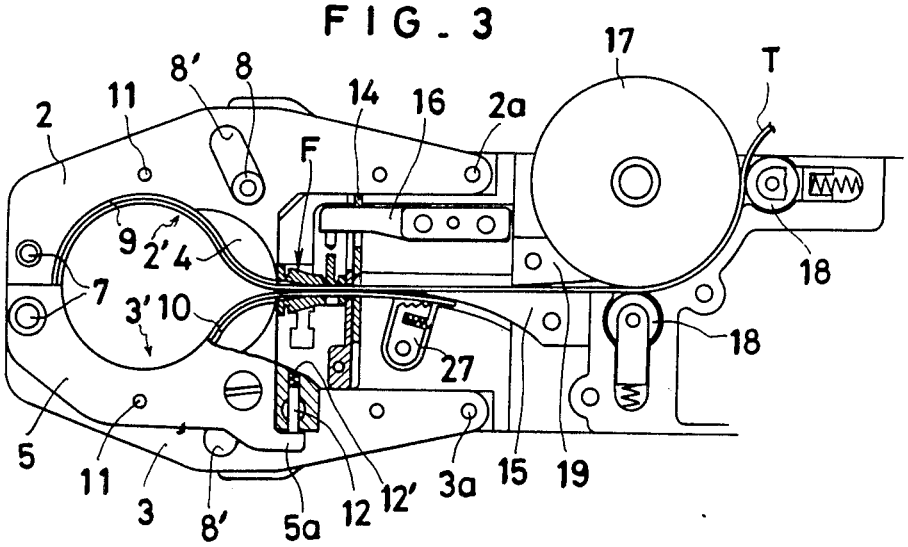
FIG. 3 is a view showing part of the binding tool after the tape has been passed around the object.
Figure 7:
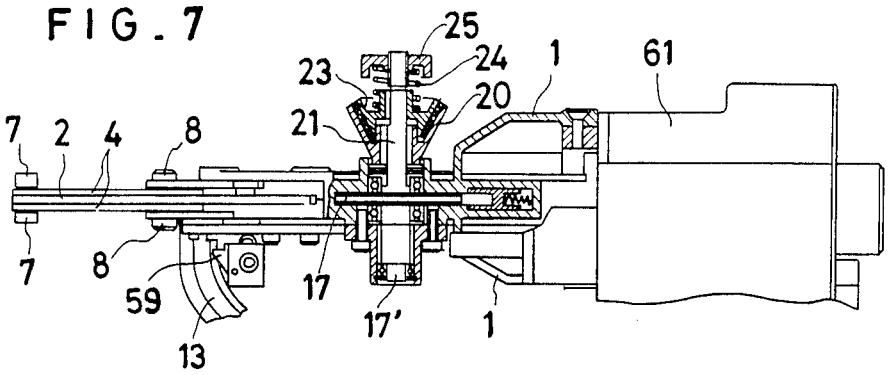
FIG. 7 is a plan view, partly in section, showing the binding tool shown in FIG. 6.
Figure 12:
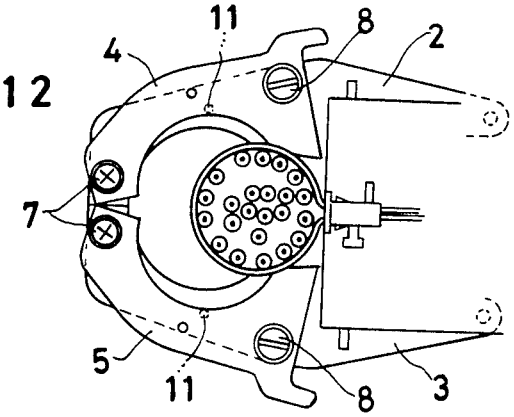
FIG. 12 is a fragmentary side view showing the binding tool with the paired side plates further rotated by the object pulled back by the tape.
Figure 13:
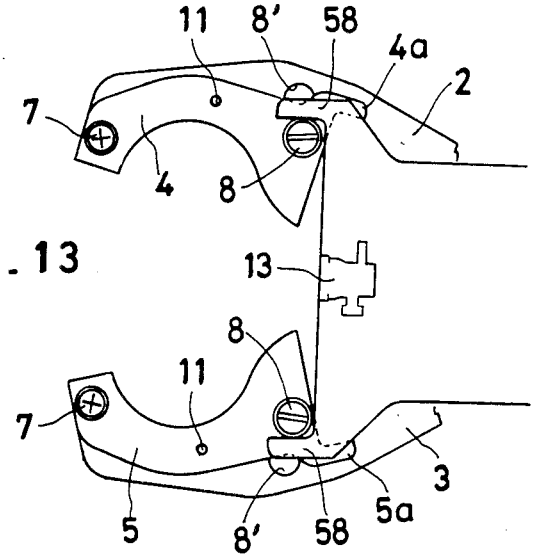
FIG. 13 is a fragmentary sectional view showing the binding tool with the jaws open and the bound object removed after completion of the binding cycle.

In the embodiment of the binding tool shown in FIGS. 1 to 22, the row of fasteners F is fed laterally, i.e., perpendicularly to the direction of progress of a tape T, by increments corresponding to the pitch of the fasteners F so as to successively come into a set position in the binding tool. Each time a new fastener comes into the set position, the tape T, which is long and continuous, is fed out by predetermined fixed length into the fasteners F from behind to form a loop of tape ahead of the fastener (FIG. 2). After forming the loop, the leading end of the tape is inserted into the fastener F from the front end thereof to be fed out a predetermined length from the rear end of the fastener, so that the tape is passed around an object W to be bound (FIG. 3). Then, the tape T is pulled back by an adjustable constant force, thereby tightening the tape T passed around the object W to a constant fastening force. Then, portions of the tape in the fastener adjacent to the opposite ends of the loop are secured to the fastener by driving the pin $f_2$ thereinto. Thereafter, the connector $f_3$ between the flange $f_1$ of the fastener in the set position and the flange $f_1$ of the next fastener is cut, and also the tape is cut at a position behind the fastener. The feeding of the row of fasteners will be described later. The pin is formed such that it can be readily separated from the associated fastener; it may be integral with the associated fastener or be a separate member mounted on the fastener.

Referring now to FIGS. 2 to 22, the binding tool illustrated has upper and lower jaws 2 and 3 which project forwardly from opposite side halves 1 of a tool body. The upper and lower jaws 2 and 3 have rearward extensions extending along the upper and lower edges thereof, respectively, and are pivoted by respective pins 2*a* and 3*a* at the rear end of the extensions. When the two jaws 2 and 3 are closed, they form between them a space substantially having the shape defined by two partly overlapping circles. In their closed state, the substantial portions of the jaws 2 and 3 face each other across the said space and have opposed concave parts 2' and 3' defining the two partly overlapping circles.

Paired side plates 4 are provided on the opposite sides of the upper jaw 2 and are spring biased against the upper jaw 2 by springs 6. Likewise, paired side plates 5 are provided on the opposite sides of the lower jaw 3 and are spring biased against the lower jaw 3 by springs 6. Each of the jaws has a pair of pins 7 and a pair of pins 8 provided in the front and rear portions thereof so as to project from the opposite sides. Each of the side plates 4 and 5 has a hole through which one of the pins 7 project. On the end portion of the pin 7 projecting from the side plate is fitted the associated spring 6, which is retained by a nut (FIG. 9). When the jaws 2 and 3 are closed, the paired side plates 4 and the paired side plates 5 are also closed. The space defined by the upper and lower paired side plates in the closed state is similar to and slightly smaller than the space defined by the two jaws in the closed state over about a three-quarter portion toward the front.

The jaws 2 and 3 have a width slightly smaller than the width of the tape T. The paired side plates 4 and 5 respectively have grooves 9 and 10 formed on their inner sides for receiving the corresponding edges of the tape. The grooves 9 and 10 have respective inclined side surfaces 9' and 10' (FIG. 9). When the jaws are closed, the tape T can proceed in the space between them with its edges guided along the grooves 9 and 10 to be passed around the object W. When the tape is subsequently pulled back to be tightened onto the object, it rides on the inclined side surfaces of the grooves to separate the side plates from the opposite sides of the jaws against the spring force of the springs 6, whereby it escapes from the grooves 9 and 10 and can be tightened around the object (FIG. 11).

The pins 8 provided on the rear portion of the paired side plates 4 and 5 are received in slots 8' formed in the jaws 2 and 3, so that the side plates are rotatable about the pins 7 provided on the front portion of the jaws. Each of the side plates has a small hole provided at an intermediate position between the front and rear ends. Each jaw has short projections 11 projecting from its opposite sides and extending into the corresponding small hole of the side plate. The paired side plates 4 and 5 for the upper and lower jaws have arms 4*a* and 5*a* in contact with the top and bottom of the body, respectively, and the body is provided with plungers 12 spring biased against the respective arms 4*a* and 5*a* by springs 12'. When the tape T escapes from the grooves 9 and 10 by separating the paired side plates from the opposite sides of the jaws for tightening around the object, the small holes of the side plates are detached from the projections 11. As a result, the side plates 4 associated with the upper jaw are pushed and turned upwards by the plunger 12, while the side plates 5 associated with the lower jaw are pushed and turned downwards by the plunger 12, whereby the rear portion of the overlapped circular space noted above, that has been concealed by the paired side plates, is exposed. The tape loop thus can be drawn in toward the front of the body while being tightened around the object.

The body is provided at a position corresponding to the tapered rear end of the space defined by the upper and lower paired side plates in the closed state with a guide 13, along which the fasteners are brought into the set position. The front end of the guide 13 opens into the front end of the body. A cutter plate 14, which has a window immediately under a cutting edge, is disposed for vertical movement immediately behind the forward end of the guide 13. A guide member 15 for guiding the leading end of the tape into the window is secured to the body behind the cutter plate 14. The cutter plate 14 depends from a hammer 16, which serves to drive pin $f_2$ into the fastener as will be described later, at a position slightly behind the front end of the hammer. A friction wheel 17 is disposed at a position rearwardly above the guide member 15. The tape passes over a part of the periphery of the friction wheel 17, and is friction fed by predetermined amounts by rotation of the friction wheel in the clockwise direction in FIG. 14. The tape is pulled back with the rotation of the friction wheel by the same amount in the reverse direction. Two small auxiliary rollers 18 are provided adjacent to the outer periphery of the friction wheel, one at the position where the tape is brought into contact with the friction wheel and the other at the position where the tape departs from the friction wheel. Each small roller 18 is spring biased by a spring 18' to urge the tape against the outer periphery of the friction wheel. A separator 19 is provided on the rear portion of the guide member 15. The separator 19 serves to separate the leading end of the tape from the outer periphery of the friction wheel and lead it onto the guide member 15.

The friction wheel 17 is fitted on a shaft 17' which can rotate in unison with a conical member 20 of a slip mechanism. A one-way clutch 21 is provided between the shaft 17' and the inner periphery of the conical member 20. A push member 23 is keyed to the shaft 17' and engages with the inner periphery of the conical member 20 via a pad 22. The push member 23 is urged against the conical member 20 by a coil spring 24, the biasing force of which is adjustable by a nut 25. A disk-like joint 26 is interposed between the friction wheel 17 and the conical member 20. It has radial ridges provided on both sides and meshes with corresponding surfaces of the friction wheel and the conical member so that it rotates in unison with these parts. When the shaft 17' rotates the friction wheel 17 in the direction of feeding out the tape, the one-way clutch 21 is coupled, so that the conical member 20, the friction wheel 17 and the push member 23 are rotated in unison. When the friction wheel is rotated by the same amount in the reverse direction to pull back the tape, the one-way clutch is de-coupled. At this time, the shaft 17' rotates the friction wheel by friction via the push member 23 and conical member 20, thus pulling the tape and tightening it around the object. When the tape which is being tightened around the object can no longer be pulled back, the push member 23 starts to slip against the conical member 20. The fastening force with which the tape is tightened around the object can be adjusted by adjusting the force of the spring 24. When the pad 22 wears out, it can be easily replaced after removing the nut 25 and the coil spring 24 from the shaft 17'.

The guide member 15 has an arcuate or inclined lower surface so that it is pointed toward the front end. A toothed stopper 27 is pivotally mounted on the body with its teeth facing the lower surface of the guide member 15 and is forwardly spring biased by a spring 27' against the lower surface.

Toggle levers 28 provided for opening and closing the upper and lower jaws 2 and 3 each has its one end linked to an intermediate portion of the rearward extensions of the associated jaw and its other end linked to the front end of a coupling arm 29, which can be advanced and retracted in the direction of travel of the tape. The coupling arm is advanced and retracted in the body. When the coupling arm 29 is in its most advanced position, the two toggle levers 28 extend straight upwardly and downwardly from the front end of the arm. In this state, the jaws are open, with the upper jaw urged upwardly and lower jaw urged downwardly. As the coupling arm 29 is retracted, the two toggle levers assume a V-shaped relationship, and the two jaws are closed. When the two jaws are closed, the front ends of the grooves 9 and 10 formed near the inner periphery of the paired side plates 4 and 5 on the opposite sides of the jaws communicate with one another.

When the coupling arm 29 is retracted from its most advanced position for closing the jaws, the leading fastener of the row of fasteners is pushed out toward the front end of the guide 13. To this end, a fastener feed arm 30 has its rear end secured to one side of the coupling arm 29 and its front end linked to one end of a lever 31, to the other end of which is linked one end of a bellcrank 32. A feed pawl 33 is coupled to the other end of the bellcrank 32 such that it can rock in the vertical direction. The feed pawl 33 is upwardly spring biased by a spring 34, which is received by a spring retainer 35 provided at the other end of the bellcrank. When the coupling arm 29 is in the advanced position, the feed pawl 33 is positioned between the leading fastener and the next fastener. In this state, it supports the leading fastener with its upper half and extends substantially horizontally against the biasing force of the spring 34. With the retraction of the feed arm 30 together with the coupling arm 29, the lever 31 is rocked to cause rocking of the bellcrank 32 about the fulcrum thereof, whereby the lower portion of the feed pawl 33 passes through an inverted T-shaped groove 36 formed in the body while the upper portion of the feed pawl pushes the leading fastener. By the time the coupling arm 29 comes to its most retracted position, the row of fasteners has been displaced by one pitch, and the leading fastener is now located at the forward end of the guide 13.

The lower portion of the feed pawl 33 is made to pass through the inverted T-shaped groove 36 so that when no fastener is loaded or when the supply of fasteners is exhausted, the jaws will be stopped in a half-open state, from which the user can know the situation. To this end, the feed pawl 33 has projections 33' projecting from its opposite sides. In the absence of fastener, the feed pawl 33 is held in an upwardly tilted state by the biasing force of the spring 34, and with the retraction of the coupling arm 29 the projections 33' comes to engage with an inlet of the groove 36 to stop the coupling arm at an intermediate position in the retraction stroke. The feed pawl 33 may have only a single projection 33' projecting from one side, and in this case an inverted L-shaped groove 36 may be formed.

The hammer 16 for driving the pin $f_2$ into the fastener F as noted before, is secured to one side of a front end portion of a lever 37, which is provided in the body to be rockable about a support pin 37'. The hammer 16 has a caulking pin 16' depending from its front end and facing the pin $f_2$ of the leading fastener at the set position at the forward end of the guide 13 from above. The lever 37 has a downwardly directed cutting edge 38 provided at its front end for cutting the connector $f_3$ between the flange $f_1$ of the leading fastener and the flange $f_1$ of the next fastener. The rear end of the lever 37 is coupled to the body by toggle levers 39 and 40 like the toggle levers 28 described above, and the front end of a bar 41 is pivotally coupled to the coupling point of the two toggle levers 39 and 40. With the retraction of the bar 41 the two toggle levers are cause to assume a straight state. At this time, the front end of the lever 37 is turned downwardly, whereby the driving of the pin $f_2$ into the fastener by the caukling pin 16' of the hammer 16 and the cutting of the connector $f_3$ between the adjacent fasteners are effected at the same time.

The retraction of the bar 41 and the coupling arm 29, and the forward and reverse rotation of the friction wheel 17 are caused by a motor in timed relation to one another. In this embodiment, this is effected by the pistons of three piston-cylinder assemblies provided in a block mounted on the opposite side halves 1 of the body.

Figure 23:
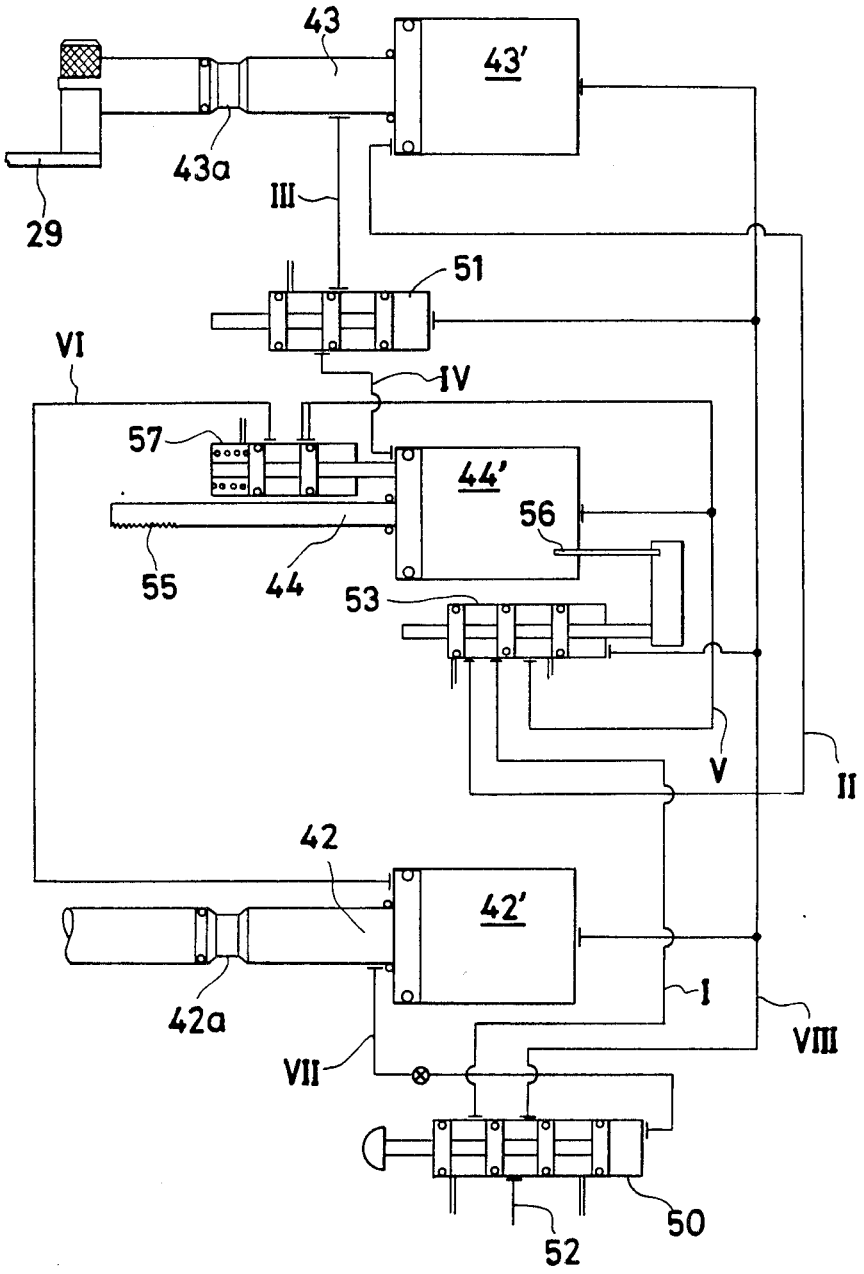
FIG. 23 is a hydraulic circuit diagram of the same cylinder block.

These pistons are shown in FIG. 23. More specifically, they are a piston 42 for operating the bar 41 to caulk the pin $f_2$, a piston 43 for operating the coupling arm 29 to open and close the jaws, and a piston 44 for rotating the friction wheel forwardly and reversely to feed and pull back the tape. These pistons are assembled together with various control valves and ports to be described later in a cylinder block. The body has a grip 45, which can be gripped by the hand. A pneumatic tube or the like for operating the pistons is coupled to a nipple 46 provided at the butt of the grip. The grip is provided with a trigger 47 which is in a convenient position for operation by the index finger when the grip is held and can be depressed in two stages.

To start the binding operation, the trigger 47 is first depressed by one stage. With this operation, the push lever 48, on which the trigger 47 is mounted, is turned to cause the arm 49 of the lever 48 to operate a first throttle valve 50. The arm 49 is pivoted on the lever 48, and the spring 49' urges the arm 49 in the direction of depressing the trigger. When the trigger 47 is depressed to the second stage, the second arm 48' provided on the lever 48 operates a second throttle valve 51. At this time, the arm 49 is turned against the force of the spring 49' to continue the operation of the first throttle valve 50.

When the finger is released from the trigger 47, the push-in of the spool of the second throttle valve 51 is discontinued, and then the push-in of the spool of the first throttle valve 50 is discontinued, so that the trigger 47 is restored to the initial state by the return spring 47'.

When the spool of the first throttle valve 50 is pushed in with the depression of the trigger 47, air is caused to flow from an inlet port 52 through the first throttle valve 50 to a port I and thence through a return valve 53 and then through a port II into a jaw-opening cylinder 43', thus causing retraction of the piston 43. As a result, the coupling arm 29 is retracted to close the upper and lower jaws 2 and 3. When the piston 43 is brought to the most retracted position, the interior of the cylinder is communicated with a port III by a small diameter portion **43*a* of the piston, causing air in the cylinder 43' to flow through the port III into the second throttle valve 51** and be blocked therein.

The object may be inserted between the jaws after closing them together, or it may be inserted while the jaws are open and then the jaws may be closed. The position of the object to be bound is then aligned with the narrow portion of the space defined by the paired side plates of the upper and lower jaws, i.e., near the forward end of the guide 13, and then the trigger 47 is depressed to the second stage. As a result, the spool of the second throttle valve 51 is pushed in, causing air that has flown into the valve to pass through a port IV into the tape feed/pull-back cylinder 44' to cause retraction of the piston 44. The piston 44 is provided with a rack 55 meshed with a pinion 54 mounted on the shaft 17' of the friction wheel 17, so that with the retraction of the piston 44 the friction wheel 17 is rotated by a constant amount in the direction of feeding out the tape.

At this time, the one-way clutch 21 is de-coupled to render the slip mechanism inoperative, as noted earlier.

With the rotation of the friction wheel 17 the leading end of the tape T enters the fastener set at the forward end of the guide 13 from behind the fastener, and then proceeds along the grooves 9 formed in the paired side plates 4 on the opposite sides of the upper jaw 2, along the grooves 10 formed in the paired side plates 5 on the opposite sides of the lower jaw 3, through the fastener from the front, and along the lower surface of the guide member 15 while rearwardly pushing the teeth of the stopper 27 to reach a position at which it is clamped between the teeth and the lower surface of the guide member 15. Since the cutter plate 14 is provided immediately behind the fastener and the window thereof under the cutting edge communicates with the interior of the fastener, the tape proceeds through the window under the cutting edge.

While the tape is fed out a predetermined amount with the retraction of the tape feed/pull-back piston 44, toward the end of the retraction of the piston, the rod 56 extending into the cylinder 44' is pushed rearwardly to move the spool of the return valve 53 coupled to the rod. The return valve 53 is thus switched, causing air to flow through the port I into the return valve 53. Thus, the air that has been flowing into the port III turns to flow in the reverse direction through a port V into the tape feed/pull-back cylinder 44' to advance of the piston 44. As the port V is also communicating with the stop valve 57, the spool of the stop valve is pushed and moved by a spring with the retraction of the piston, so that air flowing through the port V is blocked.

With the advance of the piston 44 the friction wheel 17 is rotated by the predetermined amount in the direction of pulling back the tape. At this time, the slip mechanism is operative as mentioned earlier, and the tape is drawn in to be tightened around the object with a predetermined fastening force that is dependent on the force of the spring 24. Thus, the side plates on the opposite sides of the upper and lower jaws are separated from the opposite sides of the jaws by the force of the tape escaping from the grooves 9 and 10, and are rotated by the plungers 12. The space defined by the jaws is thus exposed, and the object is pulled to the front of the body. To regulate the fully-open state of the upper and lower paired side plates the body has stoppers 58 forwardly projecting from the upper and lower ends of the opposite side halves of the body, and the heads of nuts on the pins moving along the slots 8' are adapted to strike against the stoppers 58. The side plates 4 and 5 need be turned by the plungers only to an extent sufficient to slightly shift the small holes of the side plates from the projections 11 after detachment therefrom, whereafter the side plates can be opened to the fully open state, which is determined by the stoppers 58 according to the thickness of the object. The object is then pulled to the front of the body as the loop of tape is drawn in.

While the tape is pulled back and tightened around the object by the friction wheel 17 in such manner as to pull the object to the front of the body with the advance of the piston, at the end of the advance of the piston the stop valve is switched by pushing the spool thereof against the spring. As a result, air flowing through the port V into the stop valve flows through a port VI into the caulking cylinder 42' to cause retraction of the piston 42 thereof. The piston 42 thus pulls the bar 44 to bring the toggle levers 39 and 40 to their straightly aligned state. The front end of the lever 37 is thus lowered. Thus, the pin $f_2$ is driven into the fastener by the caulking pin 16' of the hammer 16, while at the same time the connector $f_3$ between the leading fastener and the next fastener is cut by the cutting edge 38, as mentioned earlier. The hammer 16 penetrates and is vertically movable along a slot 14' formed in the cutter plate 14 above the cutting edge thereof. Thus, after the pin $f_2$ has been driven to a certain extent into the fastener to thereby slightly pull the tape back into the fastener, the hammer is brought into contact with the lower edge of the slot 14' and forces down the cutter plate so that the tape is cut by the cutting edge of the cutter plate 14.

The caulking piston 42 has a small diameter portion **42*a* formed in the front end portion thereof. The cylinder 42' communicates with the port VII by the small diameter portion 42*a*, whereby air in the cylinder 42' after the retraction of the piston 42 is caused to flow to the port VII to return the spool of the first throttle valve 50 previously pushed in by the trigger 47 to its original position. As a result, air flowing from the inlet port 52 into the first throttle valve flows through the port VIII. Since the port VIII communicates with the cylinder 42', return valve 53, second throttle valve 51 and jaw opening/closing valve 43', the caulking piston 42 and jaw opening/closing piston 43 are advanced to their initial positions, while the spools of the return valve 53 and second throttle valve 51** are also advanced to their initial positions. One binding cycle is thus completed, and the jaws are in their initial open state.

When the jaw opening/closing piston 43 is advanced in unison with the coupling arm 29 and the feed arm 30, the feed pawl 33 is moved via the lever 31 and the bellcrank 32 in the direction opposite to the direction of pushing the leading fastener to the foward end of the guide 13. Thus, the feed pawl 33 is turned downwardly against the spring 34 to pass beneath the next fastener and come between the next fastener and the third fastener to support the next fastener with its upper half. After the jaws are opened, the object bound by the tape is taken from between the jaws together with the leading fastener. Now, the next fastener becomes the leading fastener and with the subsequent closing of the jaws it is pushed by the feed pawl to the forward end of the guide 13 at the front end of the body. When the feed pawl 33 is turned downwardly against the spring 34 to pass under the next fastener as noted above, it is desirable to prevent the row of fasteners from traveling backwards along the guide. Accordingly, a spring-biased check pawl 59 is disposed over the guide at a position beyond which the third fastener moves along the guide to become the next fastener. When the third fastener comes to the position of the next fastener, the pin extending upright from it pushes the check pawl against the spring, and when the next fastener position is reached, the pin is detached from the check pawl, so that the check pawl is protruded again by the spring at a position immediately after the pin of the next fastener, thus preventing backward travel of the row of fasteners.

When the jaws 2 and 3 are opened, the projections 11 projecting from the opposite sides of the jaws are moved in contact with the inner surfaces of the paired side plates 4 and 5 as these plates turn about the pins 7 at the front portion of the jaws, and when the projections 11 come to the small holes of the side plaets, they are inserted into the small holes by the force of the springs biasing the side plates, so that the side plates are urged against the sides of the jaws and are subsequently moved in unison with the jaws.

The inclined side surfaces 9' and 10' of the grooves 9 and 10 of the side plates need not be provided over the entire length of the grooves and it is sufficient for them to be formed only over the front half of the grooves.

Further, the tape T may have a channel-shaped sectional profile as shown, and the friction wheel 17 constituting the tape reciprocation mechanism may consist of a central disk 17*a* of a width matched to the width of the central recess of the channel-shaped tape T, and two side disks 17*b* of a slightly smaller diameter than that of the central disk 17*a*, the side disks being secured to the opposite sides of the central disk 17*a*. When this arrangement is used, the side disks 17*b* are preferably provided with fine peripheral teeth to increase the friction with the tape.

The tape is supplied from a bobbin 60 and is fed out by the friction wheel. The bobbin is replaceably supported by a bobbin holder 62 provided on a cylinder block 61.

It would be heretofore impossible for the leading end of the tape emerging from the tool body through the front end of the fastener to be guided along the inner surface of upper and lower jaws. However, in this invention, since the paired side plates define, when closed, the space which has a shape like a drop of rain suspending from a leaf and which directs its leading portion to a position at which the tape is drawn out of the tool body and are spring biased against the opposite sides of the jaws, the thickness of the jaws is made smaller than the width of the tape and the opposed surfaces of the side plates are formed with grooves for guiding the edges of the tape, the tape end emerging from the front end of the fastener can be readily guided around the object so that the tape can be passed therearound.

In addition, since the paired grooves of the paired side plates have inclined surfaces, the pulling force for pulling back the tape has the effect of causing the tape to separate the side plates from the opposite sides of the jaws, whereby the tape can escape into the space defined by the jaws (or the paired side plates) to be tightened around the object. Further, when the paired side plates are separated from the associated side surfaces of the jaws, they are urged by the urging means provided on the body so that the side plates for the upper jaws are turned upwardly and the side plates for the lower jaws are turned downwardly, about the front ends of the jaws, so that the object can be pulled toward the front end of the fastener at the front end of the body as the tape is drawn and tightened around it, without any interferrence from the side plates.

The fastening force with which the tape binds the object can be adjusted as desired by adjusting the slippage of the tape reciprocation mechanism.

What is claimed is:

1. A binding tool of the type in which a fastener row consisting of a plurality of fasteners arranged side by side at a predetermined pitch is fed by increments corresponding to said pitch, a binding tape is fed into the leading fastener in a set position from behind in a tool body, the tape emerging from the front end of the fastener is passed around an object, the leading end of the tape is inserted into the fastener from the front end, the tape end emerging from the rear end of the fastener is clamped by a stopper in the body, the tape is pulled back to be tightened around the object, the tape is secured to the fastener by driving an associated pin thereinto in the body, and the tape is cut behind the fastener, the binding tool comprising:

an upper jaw and a lower jaw, both having a thickness smaller than the width of the tape, said jaws being pivotally coupled to the body at the position where the tape emerges from the front end of the fastener at the front end of the body and being arranged to form a space between them when they are closed on each other, paired side plates provided in a spring-biased relation on the opposite sides of each of said jaws so as to open and close in unison with the jaws, the paired side plates being rotatable about the front end of the jaws, holding means provided between each jaw and each of the associated side plates for holding the side plates in a tape-guiding relation with respect to the associated jaws and for releasing the side plates when the side plates are separated from the corresponding side surfaces of the jaws against biasing force, the side plates defining an enclosed space when they are closed which is smaller than the space defined by the jaws in the closed state thereof and has a narrowed portion at the position where the tape emerges from the body, grooves formed in the opposed surfaces of the paired side plates for guiding the edges of the tape, said grooves having inclined surfaces against which the edges of the tape ride to separate the side plates from the corresponding side surfaces of the jaws for escaping into the enclosed space, drive means for opening and closing said jaws, urging means having springs in contact with the side plates for pushing the side plates of the upper jaw upwardly and the side plates of the lower jaw downwardly when the jaws are closed, tape reciprocation means rotatable by a predetermined fixed amount in one direction to feed out the tape and slippedly rotatable by the same amount in the reverse direction to pull back the tape, and slip control means for controlling the slipping of said tape reciprocation means, said drive means, urging means, tape reciprocation means and slip control means being housed in said tool body.

* * * * *